US006530454B1

(12) United States Patent
Renton et al.

(10) Patent No.: US 6,530,454 B1
(45) Date of Patent: Mar. 11, 2003

(54) TWO-WAY LOCKING DEVICE FOR HEIGHT SAFETY APPARATUS

(75) Inventors: Julian E. Renton, Wiltshire (GB); Mark Woodley, Wiltshire (GB)

(73) Assignee: Latchways PLC, Wiltshire (GB)

( * ) Notice: Subject to any disclaimer, the term of this patent is extended or adjusted under 35 U.S.C. 154(b) by 0 days.

(21) Appl. No.: 09/830,197

(22) PCT Filed: Oct. 25, 1999

(86) PCT No.: PCT/GB99/03522

§ 371 (c)(1),
(2), (4) Date: Sep. 21, 2001

(87) PCT Pub. No.: WO00/24471

PCT Pub. Date: May 4, 2000

(30) Foreign Application Priority Data

Oct. 23, 1998 (GB) ..... 9823320

(51) Int. Cl.[7] ..... E04G 3/14

(52) U.S. Cl. ..... 182/36; 182/5; 104/91; 104/115

(58) Field of Search ..... 182/3, 4, 5, 36, 182/192, 234; 104/115, 182, 91

(56) References Cited

U.S. PATENT DOCUMENTS 4,846,075 A * 7/1989 Tupper ..... 104/209
5,323,873 A 6/1994 Pelofi
5,934,408 A * 8/1999 Flux ..... 182/5
6,263,999 B1 * 7/2001 Atkinson ..... 182/5
6,279,682 B1 * 8/2001 Feathers ..... 182/239
6,311,625 B1 * 11/2001 Ostrobrod ..... 104/91
6,378,650 B2 * 4/2002 Mauthner ..... 182/5
6,378,651 B1 * 4/2002 Ecker et al. ..... 182/36

FOREIGN PATENT DOCUMENTS

| | | | |
|---|---|---|---|
| EP | 0 272 782 A1 | 6/1988 | |
| EP | 0 279 929 | 8/1988 | |
| FR | 2 667 791 | 4/1992 | |
| GB | 2256408 | * 12/1992 | ..... 182/5 |
| WO | WO 95/26784 | 10/1995 | |

* cited by examiner

*Primary Examiner*—Bruce A. Lev
(74) *Attorney, Agent, or Firm*—Brooks & Kushman P.C.

(57) ABSTRACT

A fall arrest device (100) for use on an elongate support (180) including locking cams (132, 133, 134, 135) embodied by first and second independent actuable cam elements (133, 135), said cam elements (133, 135) being biased by a bias (132, 133, 134, 135) into locking engagement with the elongate support (180) and being actuated by a common arrester (128) in response to a sudden change in load experienced by the device (100) such that said first cam element (133) traps the elongate support (180) relative to a chassis (102) when the elongate support (180) slopes in a first direction and such that said second cam element (135) traps the elongate support (180) relative to said chassis (102) when the elongate support (180) slopes in a second direction.

15 Claims, 8 Drawing Sheets

TWO-WAY LOCKING DEVICE FOR HEIGHT SAFETY APPARATUS

The present invention relates to height safety equipment and, in particular, to a fall arrest device used as a mobile anchorage to secure a user to an elongate support such as a cable lifeline. Such fall arrest devices are an important item of safety equipment for maintenance and construction personnel who work in high places, since they enable the hazards of falls to be minimised.

Some known fall arrest devices suffer from the drawback that they are incapable of negotiating the intermediate brackets along the elongate support element. One solution to this problem is to provide special brackets which can be "opened" to allow the user to pass. The weakness of this approach is that the elongate support element temporarily lacks support at the very point where the installer thought it necessary and at the precise moment when it is most needed. Another potential problem is that the brackets may not necessarily be accessible to the user.

Fall arrest devices have been developed which are capable of automatically traversing intermediate brackets for the elongate support element without user intervention. Such devices typically comprise a pair of rotatable wheels having a series of recesses at spaced locations around their peripheries, the adjacent recesses being separated by a radially projecting part of the wheel. A co-operating slipper part is mounted on the wheels by means of formations which inter-engage with complementary formations on the radially projecting wheel parts. A space between the slipper part and the wheels is dimensioned to receive the elongate support element, such as a cable lifeline.

European patent application number 0 272 782 discloses in a first embodiment a self-locking fall arrest device having a locking cam which is spring biased to a locking condition in which it firmly grips a safety line to lock the device to the safety line. In use, the device is connected to a lanyard of a personnel safety harness so that the loading applied to the locking cam by the lanyard is such as to maintain the locking cam in an unlocked condition, until such loading is released, for example in a fall arrest situation whereupon the locking cam is then pivoted by its biassing spring to its locking condition.

The above-described device is designed for use on vertical or near-vertical installations but has only unidirectional capability. This means that the device must be installed on the safety line or cable in the correct orientation for safe operation. Hence, the device is unsuitable for tasks which involve the user ascending one side of a tall structure and descending the other side. In order to make such a traverse safely, the user must detach the fall arrest device at the apex and re-orient it for the descent. Otherwise, the locking cam is on the wrong side of the device for effective deployment in a fall arrest situation.

In a further embodiment EP 0 272 782 discloses a second self-locking fall arrest device which is able to operate bi-directionally on vertical or near vertical installations. However, the device can only operate on safety lines at a greater angle to the horizontal than a critical angle.

Finally, in a third embodiment EP 0 272 782 describes a further self-locking fall arrest device comprising two self-locking fall arrest devices according to the first embodiment mounted back-to-back on an articulated chassis so that one of the self-locking devices will always be correctly oriented for operation regardless of the orientation of the safety line.

In practice, the requirement for a fall arrested device which has bi-directional capability in a vertical or near-vertical orientation is rare. It is seldom the case that workers ascend one vertical or near-vertical face of a structure and ascend a vertical or near-vertical face of the same structure using a common safety line spanning the two faces. It is much more likely that the respective faces will be equipped with individual safety lines. Hence, re-attachment of the fall arrest device in the correct orientation for the descent is not problematic.

However, the situation is different for personnel engaged in work on pitched rooves, for example, where a common lifeline may span both slopes. In the circumstances, it is irksome for the user to detach, re-orient and re-attach his fall arrest equipment each time he crosses the roof apex. In practice, many workers will not bother and may either leave themselves unattached to the lifeline or may choose to work at times with the fall arrest device incorrectly oriented for effective deployment. The latter option may lead workers to assume a false sense of security because they may become confused as to which side of the roof apex is the "safe" slope.

It is therefore an object of the present invention to provide an improved fall arrest device having bidirectional capability for use on horizontal and inclined safety lines. It is a further object of the present invention to provide a fall arrest device which is capable of traversing intermediate support brackets for the safety line in hands-free manner, thereby enabling users to move about freely during execution of a variety of tasks without encumbrance. It is yet another object of the present invention to provide a fall arrest device having the capability to switch from one directional mode to another without user intervention, according to the change in slope of the user's location.

The invention is a fall arrest device for use on an elongate support such as a safety line or a track, said device comprising:

- a chassis having a safety retainer to retain the elongate support whilst allowing movement of the device therealong, and including an engaging element for slidably engaging said elongate support;
- first and second locking cams for locking the device to said elongate support in a fall arrest situation;
- a bias to urge one locking cam into locking engagement with the elongate support in response to a sudden change in load experienced by the device; and
- an attachment for attaching a personnel safety connector to the device;
- in which said first and second locking cams comprise first and second independent actuable cam elements respectively, and characterized by said cam elements being actuated by a common arrester in response to a sudden change in load experienced by the device such that said first cam element traps the elongate support between itself and said engaging element when the elongate support slopes in a first direction and such that said second cam element traps the elongate support between itself and said engaging element when the elongate support slopes in a second direction.

For the avoidance of doubt, it is hereby stated that the above references to the elongated support sloping in a first direction or sloping in a second direction means sloping in a sense having a positive gradient or a negative gradient. The meaning of the term "positive gradient" is to be interpreted by reference to Cartesian co-ordinates as rising from left to right, whilst a "negative gradient" is to be regarded as rising from right to left.

Preferably, the device includes at least one rotary member having at least one recess formed in its periphery, the rotary member being rotatably mounted in relation to said retainer. The recess is adapted to traverse an intermediate support used to support the elongate support, without the need for user manipulation, by rotation of the rotary member relative to the retainer such that elements of the intermediate support are successively received, guided and passed by the recess automatically.

In such embodiments, the rotary member may be a wheel having a plurality of petals projecting radially from a hub of the wheel, said petals defining between adjacent pairs thereof recesses for traversing safety line intermediate supports. An example of a device having this traversing capability is described in the applicant's European patent application number 0 782 469, the disclosure of which is incorporated herein by reference.

The retaining means may include at least one slipper element for slidably engaging the elongate support and may co-operate with the wheel such that the wheel can rotate with respect to the slipper element whilst traversing the elongate support.

In addition, the device may be designed for easy attachment to and removal from the elongate support by making the components of the retainer movable relative to each other in such a way that a passageway may be created to allow access of the elongate support. An example of the fall arrest device having such removal/attachment capability is described in the applicant's co-pending European patent application number 0 752 899, the disclosure of which is incorporated herein by reference.

The common arrester may comprise an arrester arm or a pair of arrester arms pivoted to the chassis and an arrester pin forming an axle for the locking cams, the arrangement being such that the arrester pin obstructs the pivotal movement of the arrester arm or arms in a fall arrest situation. Preferably, the arrester arm or arrester arm pair is alleviated above the arrester pin during normal use so that, in a fall arrest situation, the arrester arm or arrester arm pair is suddenly pulled downwards into contact with the arrester pin. It is the thrust exerted by such engagement with the arrester pin that causes locking engagement of one of the cam elements with the elongate support.

In an especially preferred form of the device, the locking cam elements are mounted at the ends of the cam links which are pivotally mounted on respective arrester arms. The pivot points are preferably formed as knuckles which serve as guides keeping the device in correct alignment with the elongate support. The knuckles may include torsion springs which, during normal operation, hold the cam profiles away from the elongate support. The action of these torsion springs also maintains contact between the knuckles and the elongate support. This includes a frictional resistance to sliding, thereby ensuring that, in the event of a fall, the victim falls faster than the device. In this way, actuation to fall arrest mode is quicker.

Preferably, the device includes a manually-operable switch to enable it to be reconfigured for safe operation according to the direction of the slope on which the user is working. As indicated above, the arrester arm or arrester arm pair needs to be above the arrester pin for effective operation of the device in a fall arrest situation. Therefore, when the user moves to a slope of opposite gradient, he needs to move the arrester arm or arrester arm pair past the arrester pin to the other side of the device. The manually-operable switch allows the arrester arm/arrester pin assembly to be moved relative to each other without the thrust engagement that would otherwise cause cam locking.

In an alternative arrangement, the switching can be arranged to occur automatically when the device passes through the horizontal between two slopes of opposite gradient. A gravity or pendulum switch is suitable for this arrangement. During normal use on a sloping surface, the gravity switch is incorrectly oriented relative to the arrester arm or arrester arm pair to allow accidental switching to occur. Likewise, during a fall arrest situation, the orientation of the switch relative to the arrester arm or arrester arm pair ensures that the arrester arm or arrester arm pair engages the arrester pin to effect cam locking.

Usually, the attachment for attaching personal safety means to the device is found at the opposite end of the arrester arm or arrester arm pair from its pivot point on the chassis means.

The invention will now be particularly described by way of example only with reference to the drawings, in which.

Figure 1:
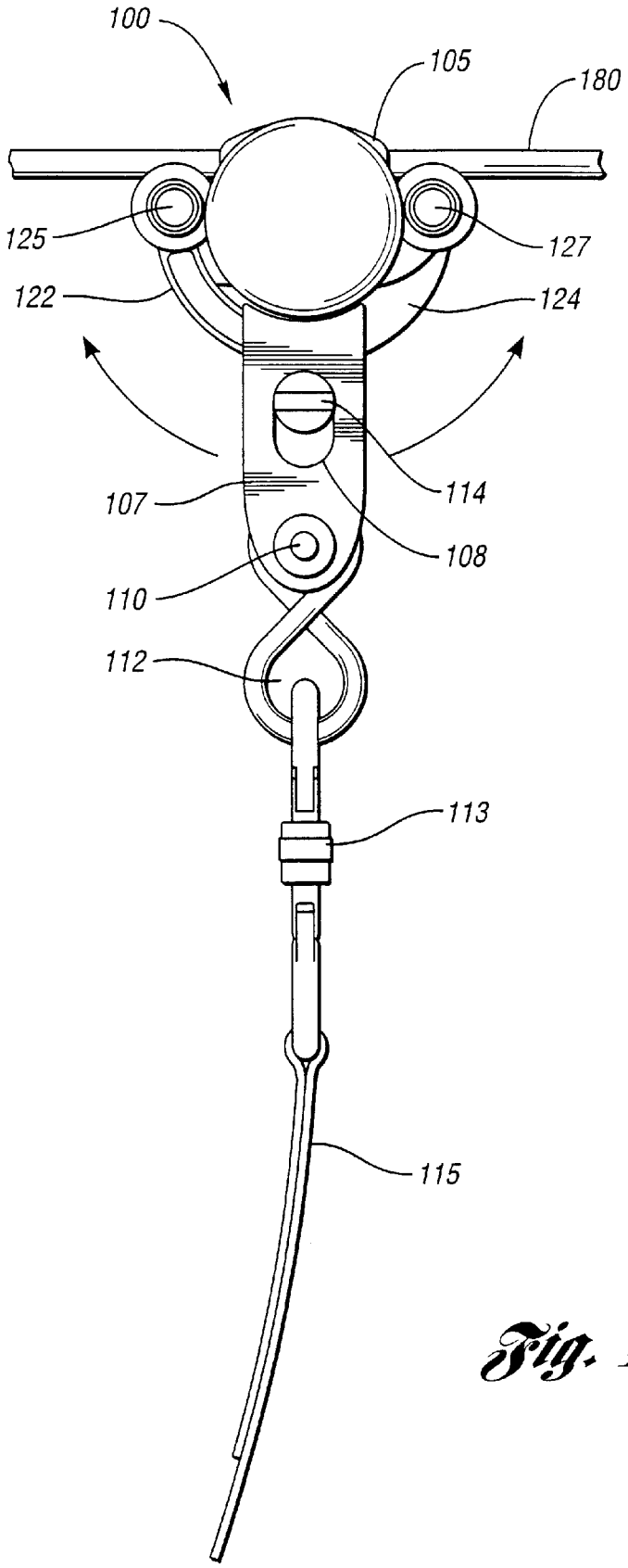
FIG. 1 is a side view of a first embodiment of a device in accordance with the present invention.

The device depicted in FIG. 1 is a first embodiment of a two-way locking device in accordance with the present invention. The device 100 is shown here in side view attached to an elongate support shown as a safety line 180 which is typically a multi-strand metal safety cable.

Figure 6:
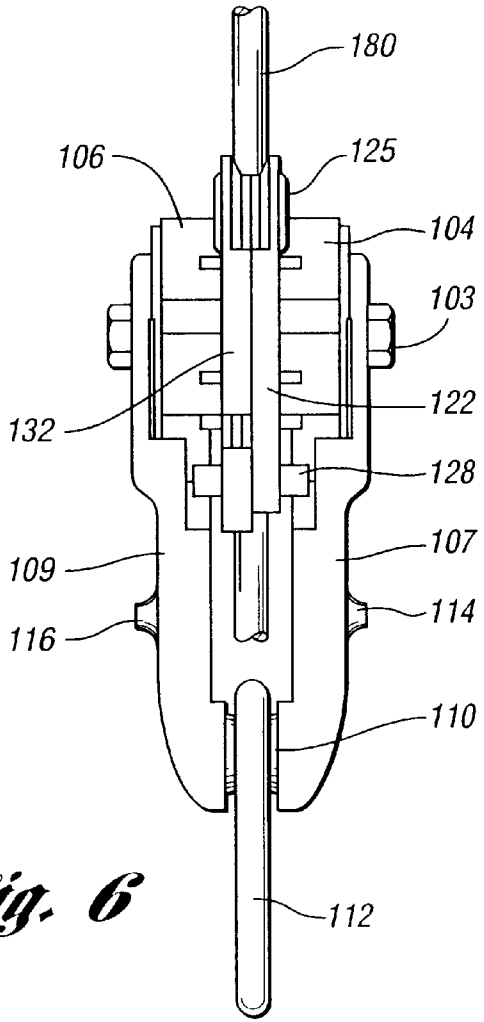
FIG. 6 is a front view of the device depicted in FIG. 5.
Figure 5:
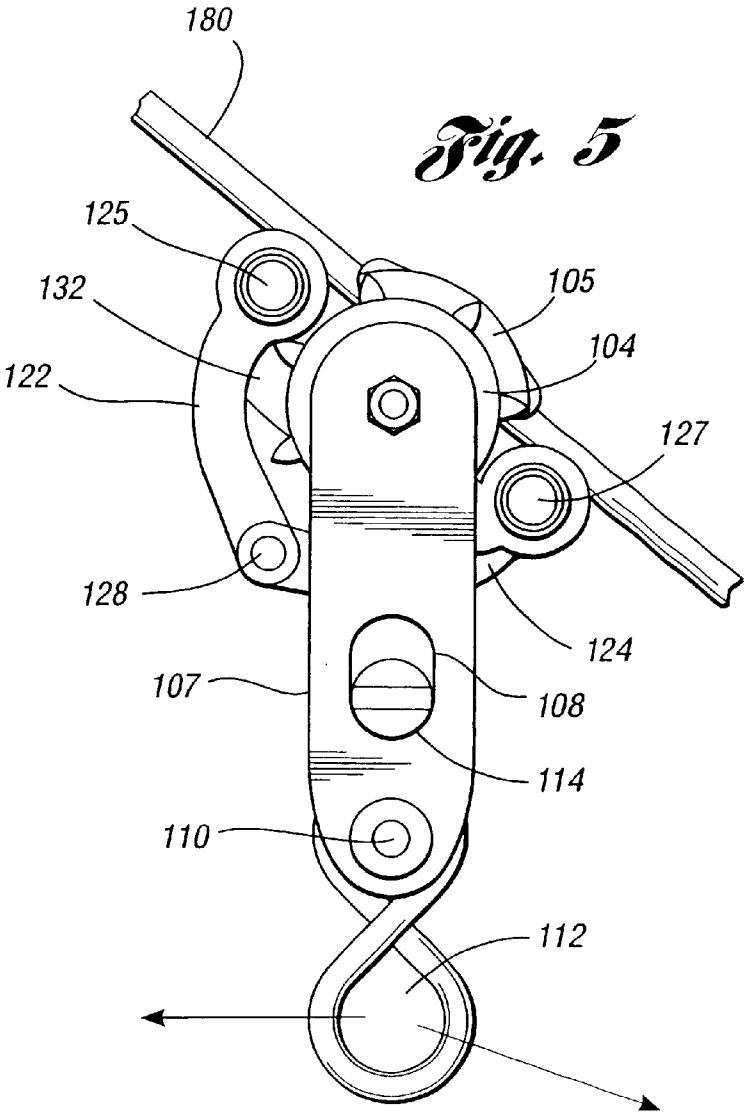
FIG. 5 is a side view of the device of FIG. 3 showing the device installed on a "negative" slope.

As best seen in relation to FIG. 6 in combination with FIG. 1, the device 100 comprises a pair of rotary members 104, 106 mounted on a common axle 103. The rotary members 104, 106 straddle the elongate safety element 180 and a safety element retaining member 105 retains the device 100 on the elongate safety element 180 once installed.

The rotary members 104, 106 are preferably in the form of so-called "starwheels" which have a central hub portion and a plurality of radially outwardly projecting petals with evenly spaced recesses therebetween. The arrangement of the starwheels 104, 106 and the retaining means 105 enables the device 100 to traverse intermediate support brackets which are provided periodically along the length of the elongate safety element 180, without user intervention and without requiring the device 100 to be detached from the elongate safety element 180. Starwheels 104, 106 are rotatably mounted in relation to the retaining means 105 and the recesses between the starwheel petals are adapted to traverse intermediate support brackets for the elongate safety element 180 by rotation of the starwheels 104, 106 relative the retaining means 105 such that elements of the intermediate support brackets are successively received, guided and passed by a starwheel recess automatically.

The device 100 further comprises a pair of side plates 107, 109 which are mounted on the common axle 103 outboard of the starwheels 104, 106. The side plates 107, 109 have a connector portion 110 at their ends remote from the mounting on the common axle 103. The connector portion 110 carries a connector eye 112 which enables connection to a personnel safety lanyard 115 by means of a karabiner 113 or similar connector.

As best seen in FIGS. 1, 3, 4 and 5, the device 100 includes a longitudinal slot 108 in the side plate 107. A pushbutton 114 projects through the slot 108 and is manually operable between a blocking position in which side-to-side movement of the side plates 107, 109 relative to the device 100 is restricted and a release position in which such side-to-side movement of the side plates 107, 109 relative to the device 100 is permitted. The purpose of the pushbutton 114 and the movement of the side plates 107, 109 relative to the device 100 will be explained in more detail below.

As best seen in FIG. 6, side plate 109 has an associated pushbutton 116 which is accommodated in a slot corresponding to slot 108 but which is not shown in any of the views in the present specification.

Figure 2:
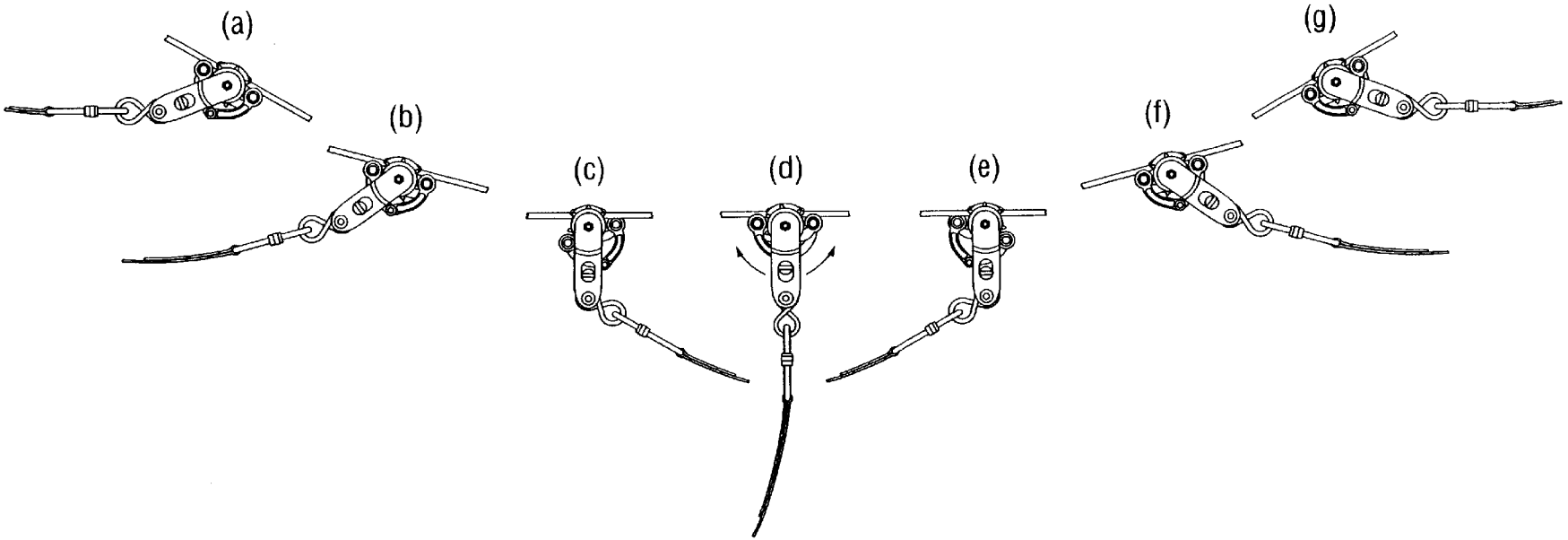
FIG. 2 is a series of side views of the device of FIG. 1 showing how it is used in different configurations according to the direction of slope of the system safety line on which it is installed.

Turning now to FIG. 2, this shows a series of views of a device 100 in accordance with the first embodiment of the present invention showing its deployment on short lengths of safety line at different angles of inclination to the horizontal. On the left hand side of this Figure, views 2(*a*) and 2(*b*) show the device ascending a "negative" gradient in accordance with the definitions used in this specification. On the right hand side of the Figure, views 2(*f*) and 2(*g*) show the device 100 ascending a "positive" gradient. In the centre view 2(*d*), the device is shown in a neutral condition and, at FIG. 2(*c*) the device is shown locked to the elongate safety element 180 by means of a tensile force pulling to the right whilst, at FIG. 2(*e*), the device is shown locked to the elongate safety element 180 by means of a tensile force pulling to the left.

Figure 3:
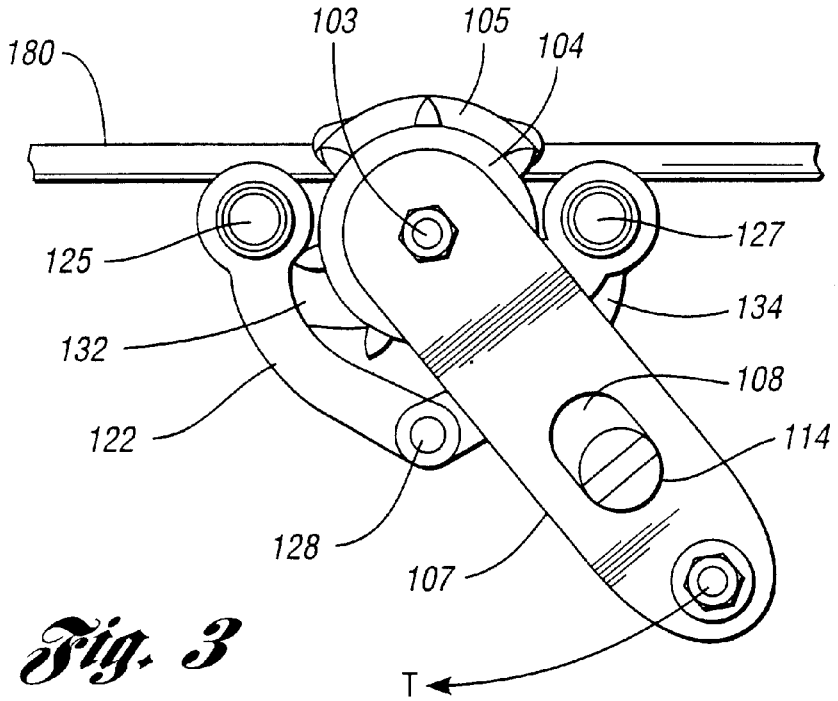
FIG. 3 is a side view of a device in accordance with FIG. 1, with some of the parts omitted for clarity.

The mechanism of locking to the elongate safety element 180 will now be explained in more detail with reference to FIGS. 3 and 4, which are partial side views of a device in accordance with the first embodiment of the invention with some parts omitted for clarity. FIG. 3 shows the device 100 with the side plates 107, 109 (only one shown) deployed to the right of the arrester pin 128. If a tensile force is exerted in the direction of arrow T, the side plates 107, 109 come into contact with the outwardly-projecting portions of the arrester pin (see FIG. 6) and thereby transmit the tensile force through arrester arm 122 which urges the knuckle 125 into greater frictional engagement against the elongate safety element 180. At the same time, the arrester arm 124 is moved such that its knuckle 127 becomes disengaged from the elongate safety element 180. The cam link 134 rotates in a clockwise sense relative to the arrester arm 124 about the knuckle 1 27 and urges the cam 135 hard against the elongate safety element 180 to effect an arresting force on the elongate safety element 180, trapping it between the cam 135 and the retaining element 105.

Figure 4:
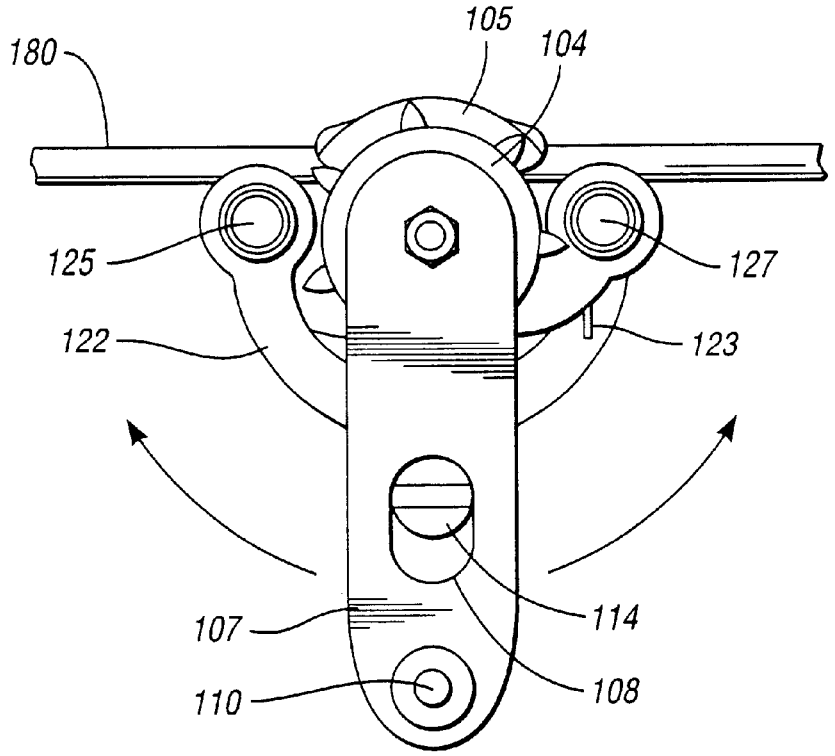
FIG. 4 is a similar view to FIG. 3 showing the device with its configuration switch deployed, thereby enabling it to be moved to a different operating condition for use on a slope of opposite gradient.

In FIG. 4, the device 100 is shown in a neutral condition with the side plates 107, 109 overlying the arrester pin 128. This condition can only be achieved when the pushbuttons 114, 116 are urged from their rest position at the end of the slot 108 nearest to the connector portion 110 to the release position at the end of the slot 108 nearest the common axle 103.

Preferably, the pushbuttons 114, 116 are urged to their rest position at the end of the slot 108 nearest the connector portion 110 by means of spring biasing. This prevents the pushbuttons 114, 116 being inadvertently disposed in the slot in a condition which will allow movement of the side plates 107, 109 past the arrester pin 128. Such movement is only desired when the gradient of the elongate safety element 180 to which the device 100 is attached changes from a "positive" to a "negative" gradient and vice versa.

More particularly, it is preferred for the push buttons 114, 116 to be biased to the end of the slot 108 nearest to the connector portion 110 to minimise the risk of inadvertent actuation (release) by a falling person who instinctively makes a grab for the device 100. By making the movement of the pushbuttons 114, 116 to the release condition a movement towards the elongate safety element 180, the risk of inadvertent actuation (release) is minimised.

Figure 7:
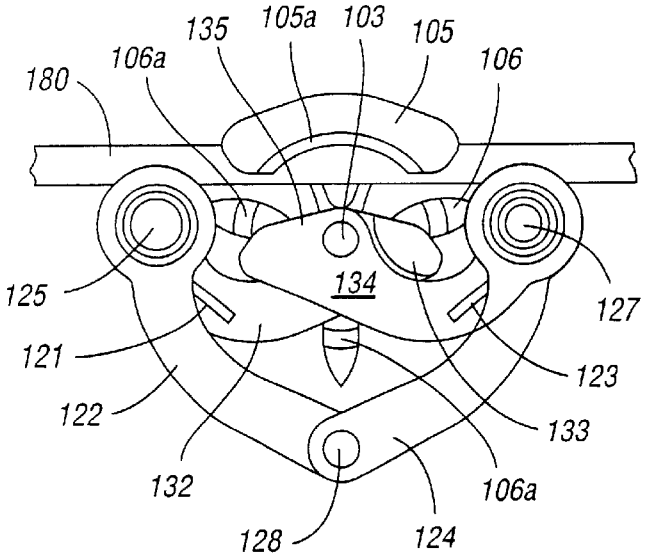
FIG. 7 is a partial side view of a first embodiment of the invention with more of the parts omitted for clarity.
Figure 8:
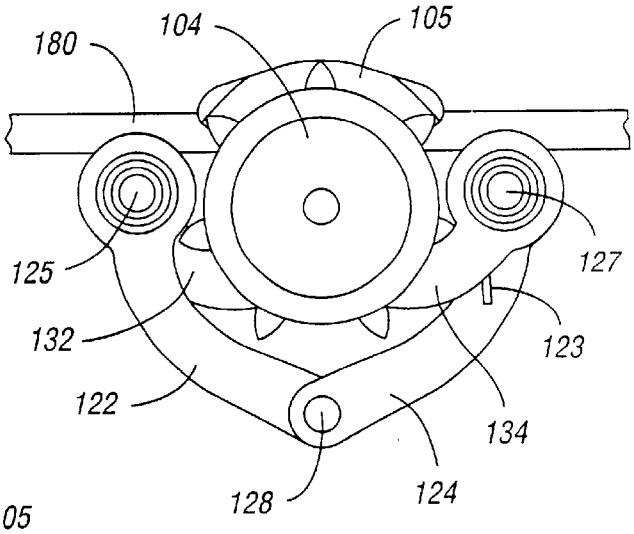
FIG. 8 is a view similar to FIG. 7 showing the device with a second star-wheel in place.

FIGS. 7 and 8 are further side views of the device 100 according to a first embodiment of the present invention with different elements omitted for a better understanding of the internal workings of the device. In FIG. 7, the starwheel 104 and the side plate 107 have been omitted. The starwheel 106, which would be behind the plane of the paper, is still visible. Retaining element 105 can be seen partially surrounding the elongate safety element 180. Feature 105*a* is an outwardly-projecting arcuate flange which is received in complementary arcuate grooves 106*a* on the inner faces of the starwheel petals.

FIG. 8 shows the device of FIG. 7 with starwheel 104 in place, engaged with retaining member 105 by virtue of the aforementioned arcuate flange 105*a* being received in arcuate grooves (not shown) on the inner face of the petals of starwheel 104.

Figure 9:
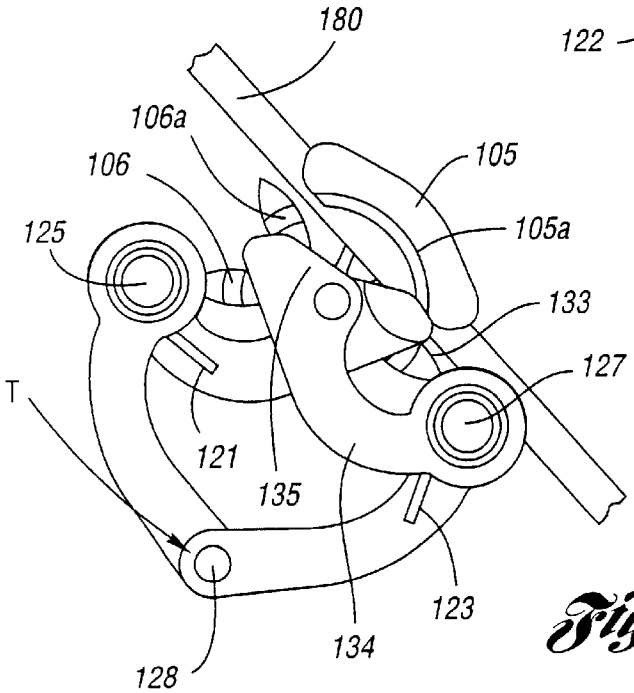
FIG. 9 is a partial side view of the device depicted in FIG. 7, showing deployment of one of the cams in a fall arrest situation on a "negative" slope.
Figure 10:
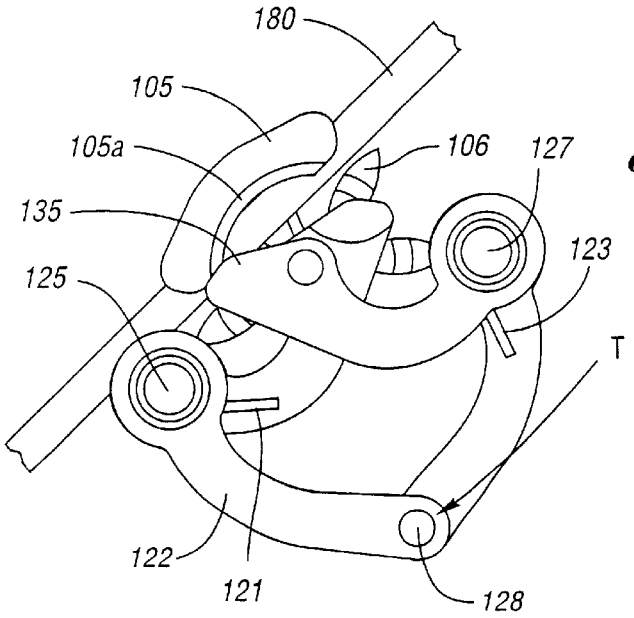
FIG. 10 is a similar view showing deployment of the other cam member in a full arrest situation in a "positive" slope.

FIGS. 9 and 10 show the device 100 in partial side view with some parts omitted for clarity so that the locking deployment of the respective cams 133 and 135 can be seen, according to whether the device 100 is installed on an elongate safety element 180 having a "negative" slope (FIG. 9) or a "positive" slope (FIG. 10). The direction of the arrow T in each of these Figures shows the direction of a tensile force that would be exerted on the device by a falling person. In each case, it will be seen that the lower-most cam is deployed to lock the device 100 onto the elongate safety element 180.

Figure 11:
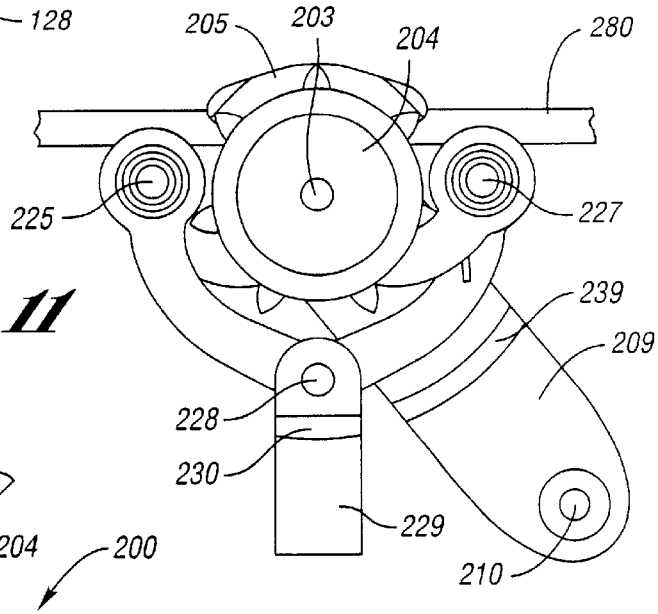
FIG. 11 is a side view of a second embodiment of the present invention showing a gravity switch.
Figure 12:
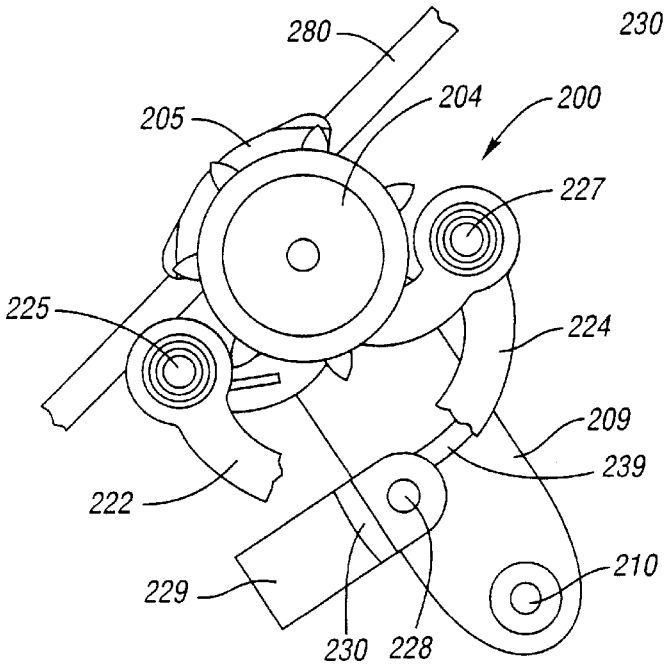
FIG. 12 is a side view of the device depicted in FIG. 11 with portions of the arrester arms omitted to show the orientation of the gravity switch in a fall arrest situation on a "positive" slope.

Turning now to FIGS. 11 and 12, these drawings show a side view of a second embodiment of the invention which employs a gravity switch to allow movement of the side plates past the arrester pin. In these drawings, similar reference numerals have been used to denote features of the invention corresponding to those described above in relation to the first embodiment. In FIGS. 11 and 12, the reference numerals have all been increased by 100.

The two-way locking device 200 comprises a chassis as before carrying a pair of starwheels 204, 206 on a common axle 203 and having a pair of side plates 207, 209 (only one shown) mounted on the common axle 203 outboard of the starwheels 204, 206.

In the device 200 according to this second embodiment, the arrester pin 228 also carries a pendulum 229 with a raised transverse ridge 230 on at least one of its faces. The ridge 230 is slightly arcuate in form and is dimensioned to be received in an arcuate recess 239 formed on the inner surface of side plate 209. Side plate 207, which has been omitted from these views, may be provided with a corresponding arcuate recess to accommodate a corresponding transverse arcuate ridge on the other surface of the pendulum 229.

In FIG. 12, the device 200 is shown installed on a "positive" gradient. The connector eye 212 is in its effective working position above the arrester pin 228 and the pendulum 229 is suspended from the arrester pin 228 below the side plate 209. More precisely, raised transverse ridge 230 of the pendulum 229 is abutted against the lower edge of side plate 209. In this condition, the raised transverse ridge 230 is unable to pass into the arcuate recess 239 formed on the surface of side plate 209. As a result, the device 200 is maintained in the required working configuration for fall arrest on a "positive" gradient.

In FIG. 11, the device is shown installed on a horizontal portion of the elongate safety element 280. In this condition, the pendulum 229 is enabled to swing about its mounting on the arrester pin 228 to a neutral orientation which aligns its raised transverse ridge 230 with the arcuate recess 239 formed on the surface of side plate 209. It is now possible for the side plate 209 to be swung in an anti-clockwise direction relative to the common axle 203 mounting the starwheels 204, 206, past the arrester pin 228. The device 200 is then ready for passage onto a portion of the elongate safety element 280 having a "negative" gradient.

It is only possible for the raised transverse ridge 230 on the pendulum 229 to align with the arcuate recess 239 on the side plate 209 when the device 200 is in a neutral orientation on a horizontal portion of the elongate safety element 280. It will be understood by skilled persons that corresponding formations could be provided on a second side plate 207 if required. This has simply been omitted from the present drawings and related description for ease of explanation, Turning now to FIGS. 13 to 17, these drawings show a third embodiment of the present invention which is characterised by being readily attachable to or removable from elongate safety element 380 without requiring special entry gates or similar devices.

Figure 14:
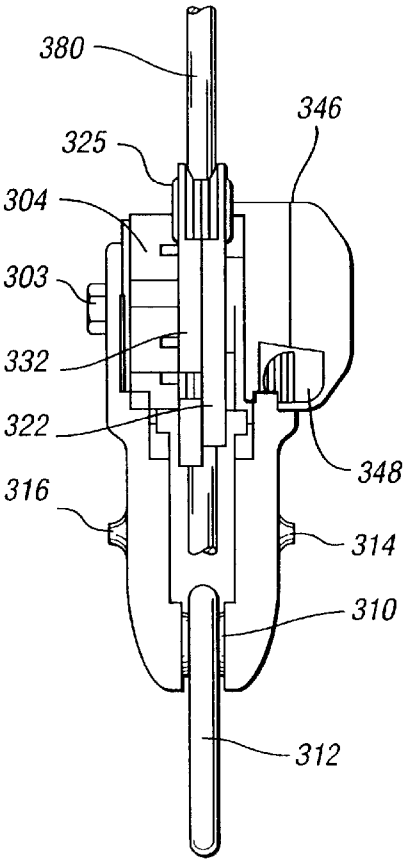
FIG. 14 is a front view of the device depicted in FIG. 13, showing the release button which facilitates ready attachment or removal of the device to or from the system safety line.
Figure 13:
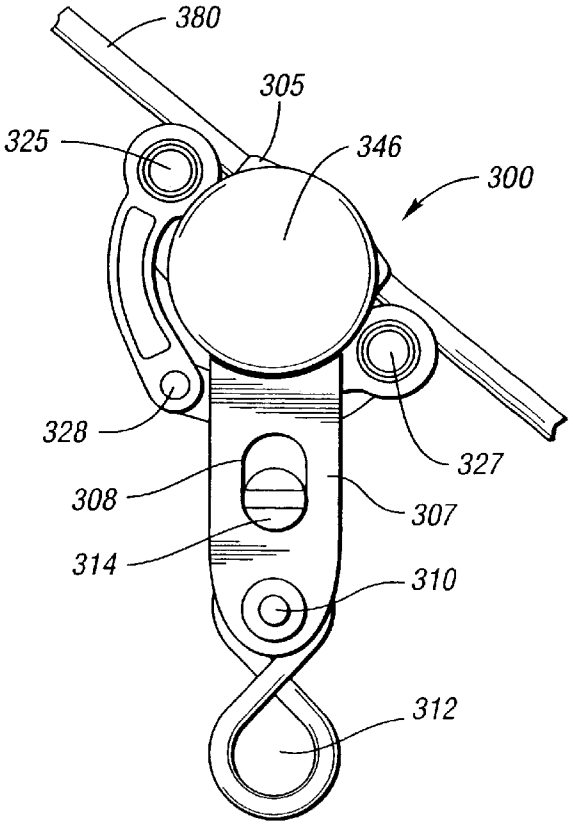
FIG. 13 is a side view of a third embodiment of the present invention shown installed on a "negative" slope.

FIG. 13 shows the device 300 in side view installed on a portion of elongate safety element 380 having a "negative" gradient. FIG. 14 is a front view of the device depicted in FIG. 13, from which it will be seen that the device comprises only one starwheel 304. The right hand side of the device 300 is a body member 346 having a manually-operable push button 348 which is effective, when deployed, to release at least one of the starwheel 304, retaining means 305 and body member 346 for relative movement away from the others of such parts to create a passageway between them which is large enough to receive the elongate safety element 380.

Figure 15:
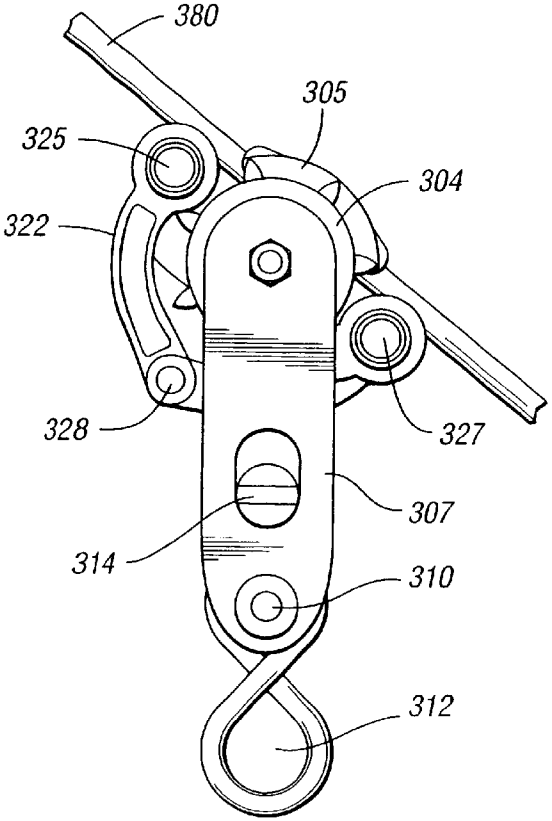
FIG. 15 is a side view showing the device of FIG. 13 with some parts omitted for clarity.

Otherwise, the device 300 is similar in appearance and operation to the device 100 described above in relation to FIGS. 1 to 10. For example, as best seen in FIG. 15, the device 300 includes an arcuate recess and a surface on side plate 307 which allows passage of the arrester pin 328 only when the pushbutton 314 is moved from its rest position to its release position. In the Figure, the pushbutton 314 is shown in the rest position, i.e. at the end of slot 308 nearest connector portion 310.

Figure 16:
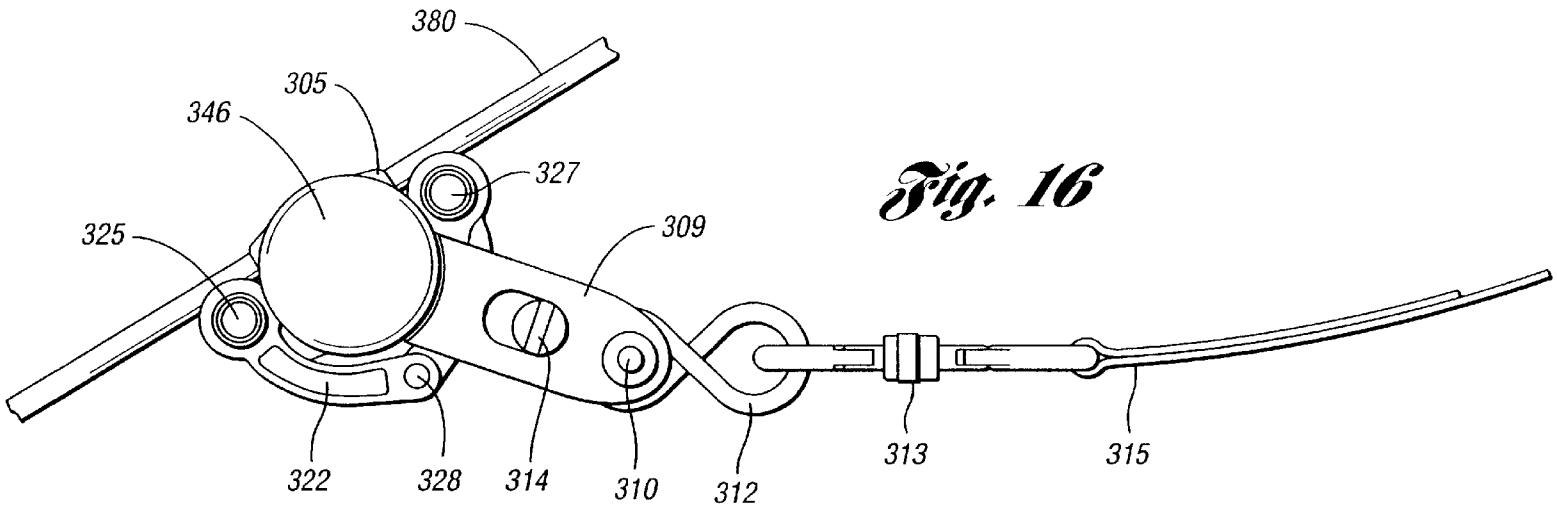
FIG. 16 is a side view of the device depicted in FIG. 13 showing its deployment in normal use on a "positive" slope.

FIG. 16 shows the device of FIG. 13 deployed in normal use on a portion of elongate safety element 380 having a "positive" gradient. The arrester pin 328 is alleviated below the side plate 309 and the personnel safety lanyard 381 is attached to a personnel safety harness at a point above the location of the device 300 on the elongate safety element 380.

Figure 17:
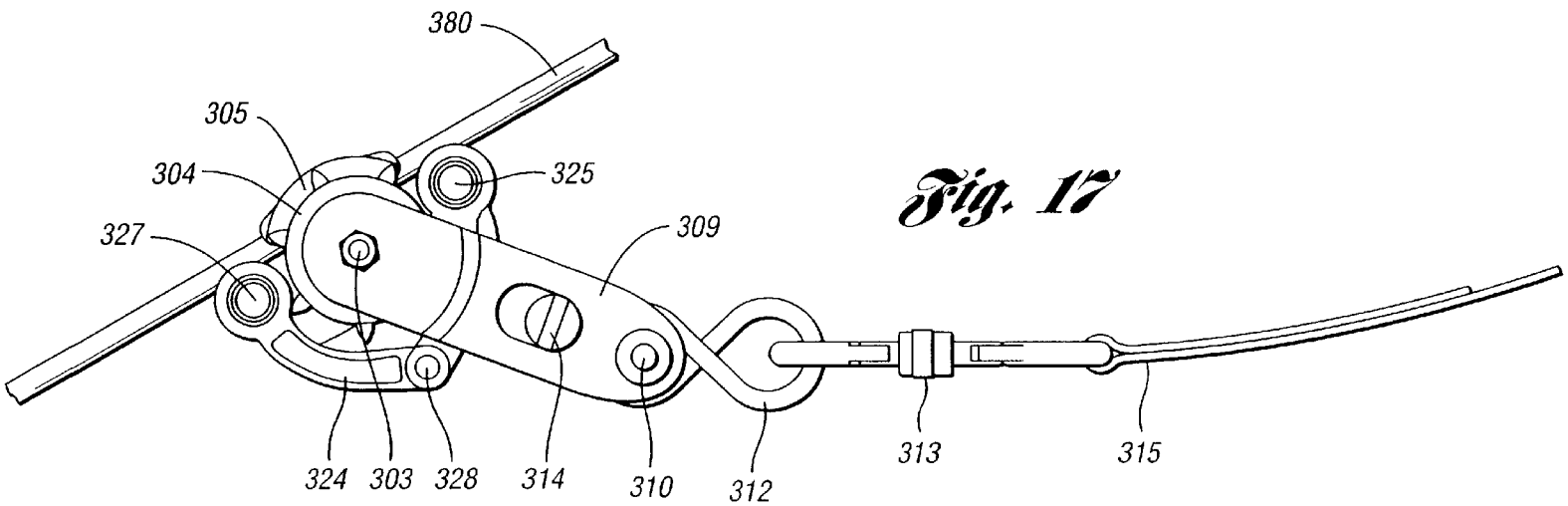
FIG. 17 is a partial side view of the device depicted in FIG. 16, with some parts omitted for clarity.

FIG. 17 effectively shows the device of FIG. 13 in the opposite orientation. Although the elongate safety element 380 is shown with a "positive" gradient according to the definitions which have been consistently applied throughout this specification, the reverse of the device 300 is shown. In this view, the starwheel 304 is depicted above the plane of the paper whereas, in FIG. 16, the body member 346 is depicted above the plane of the paper. It will be noted that FIG. 17 shows the arrester pin 328 to be alleviated below the side plate 30. This is essential for effective locking of the device on the elongate safety element 380 in a fall arrest situation.

Although the invention has been particularly described above with reference to specific embodiments, it will be understood by persons skilled in the art that various improvements and modifications are possible without departing from the scope of the claims which follow.

What is claimed is:

1. A fall arrest device (100) for use on an elongate support (180), said device comprising:

a chassis having a safety retainer (105) to retain the elongate support whilst allowing movement of the device therealong, and including an engaging element (105) for slidably engaging said elongate support;

first and second locking cams (132, 133, 134, 135) for locking the device to said elongate support in a fall arrest situation;

a bias (122, 124, 128) to urge one locking cam into locking engagement with the elongate support in response to a sudden change in load experienced by the device; and an attachment (110, 112) for attaching a personnel safety connector (113, 115) to the device;

in which said first and second locking cams comprise first and second independent actuable cam elements (133, 135) respectively, and characterized by said cam elements being actuated by a common arrester (107, 109, 128) in response to a sudden change in load experienced by the device such that said first cam element (133) traps the elongate support between itself and said engaging element when the support slopes in a first direction and such that said second cam element (135) traps the elongate support between itself and said engaging element when the elongate support slopes in a second direction.

2. A fall arrest device as claimed in claim 1 wherein the common arrester comprises at least one arrester element (107, 109) pivoted to the chassis and an arrester pin (128) forming an axle for the bias, the arrangement being such that the arrester pin obstructs arrester element pivotal movement in a fall arrest situation.

3. A fall arrest device as claimed in claim 1 or claim 2 wherein the device includes at least one rotary member (104, 106) having at least one recess formed in its periphery, the rotary member being rotatably mounted in relation to said retainer, said recess being adapted to traverse an intermediate support used to support the elongate support by rotation of the rotary member relative to the retainer such that elements of the intermediate support are successively received, guided and passed by the recess automatically.

4. A fall arrest device as claimed in claim 3, wherein the rotary member is a wheel having a plurality of petals projecting radially from a hub of the wheel, said petals defining between adjacent pairs thereof recesses for traversing intermediate supports of the elongate support.

5. A fall arrest device as claimed in claim 1 wherein the engaging element is a slipper element (105) for slidably engaging said elongate support.

6. A fall arrest device as claimed in claim 5 wherein said slipper element co-operates with the wheel in a manner such that the wheel can rotate with respect to the slipper element whilst traversing the elongate support.

7. A fall arrest device as claimed in claim 1 wherein components of the retainer are movable relative to each other in such a way that a passageway is created to allow access of the elongate support for easy attachment to and removal from the elongate support.

8. A fall arrest device as claimed in claim 1 wherein the locking cam elements are mounted at the ends of cam links (132, 134) by pivots (125, 127) mounted on respective arrester arms (122, 124).

9. A fall arrest device as claimed in claim 8 wherein the pivots are formed as guides which keep the device in correct alignment with the elongate support.

10. A fall arrest device as claimed in claim 8 or claim 9 wherein the pivots include torsion springs which hold the cam elements away from the elongate support except in a fall arrest situation.

11. A fall arrest device as claimed in claim 10 wherein said torsion springs maintain contact between the pivots and the elongate support.

12. A fall arrest device as claimed in claim 11 wherein said contact between said pivots and the elongate support causes frictional resistance to sliding of the device, thereby ensuring that the victim falls faster than the device in a fall arrest situation.

13. A fall arrest device as claimed in claim 1 further comprising a switch (114, 116, 229) to enable it to be reconfigured for safe operation according to the direction of the gradient of the elongate support on which it is deployed.

14. A fall arrest device as claimed in claim 13 wherein the switch (114, 116) is manually operable.

15. A fall arrest device as claimed in claim 13 wherein the switch (229) is a gravity switch.

* * * * *